US005921679A

United States Patent [19]

Muzzio et al.

[11] Patent Number: 5,921,679

[45] Date of Patent: Jul. 13, 1999

[54] METHOD OF CHAOTIC MIXING AND IMPROVED STIRRED TANK REACTORS

[75] Inventors: Fernando J. Muzzio, Monroe; David J. Lamberto, Edison, both of N.J.

[73] Assignee: Rutgers, the State University of New Jersey, Piscataway, N.J.

[21] Appl. No.: 08/878,896

[22] Filed: Jun. 19, 1997

Related U.S. Application Data

[62] Division of application No. 08/533,363, Sep. 25, 1995, abandoned.

[51] Int. Cl.[6] ..... B01F 7/00

[52] U.S. Cl. ..... 366/348; 366/241; 366/137

[58] Field of Search ..... 366/349, 136, 366/241, 601, 348, 276; 137/3

[56] References Cited

U.S. PATENT DOCUMENTS

| | | | |
|---|---|---|---|
| 4,715,723 | 12/1987 | Anderson et al. . | |
| 4,828,395 | 5/1989 | Saito et al. . | |
| 4,873,060 | 10/1989 | Rieder . | |
| 4,890,929 | 1/1990 | Okada et al. | 366/279 |
| 5,055,284 | 10/1991 | Andrews et al. . | |
| 5,071,728 | 12/1991 | McKinnie et al. . | |
| 5,102,630 | 4/1992 | Lee . | |
| 5,112,192 | 5/1992 | Weetman | 366/330.5 |
| 5,158,434 | 10/1992 | Weetman | 366/330.5 |
| 5,259,670 | 11/1993 | Brown . | |
| 5,267,790 | 12/1993 | Sutherland et al. . | |
| 5,375,927 | 12/1994 | Hermsen et al. . | |
| 5,399,014 | 3/1995 | Takata et al. | 366/262 |
| 5,403,088 | 4/1995 | Killmer et al. . | |
| 5,556,198 | 9/1996 | Dickson, Jr. et al. . | |

OTHER PUBLICATIONS

F. Muzzio et al, "Mixing Distributions Produced by Multiplicative Stretching in Chaotic Flows", *Int. J. Bifurcation and Chaos,* 2(1): 37–50 (1992) [Muzzio I].

F. Muzzio et al, "Scaling and Multifractal Properties of Mixing in Chaotic Flows", *Phys. Fluids A,* 4(7):1439–1456 (Jul., 1992) [Muzzio II].

F. Muzzio et al, "The Statistics of Stretching and Stirring in Chaotic Flows", *Phys. Fluids A,* 3(5):822–834 (May, 1991) [Muzzio III].

F. Muzzio et al, "Self–Similar Drop–Size Distributions Producted by Breakup in Chaotic Flows", *Phys. Rev. Lett.,* 67(1) :54–57 (Jul., 1991) [Muzzio IV].

F. Muzzio et al, "Coagulation in Chaotic Flows", *Phys. Rev. A,* 38(5): 2516–2524 (Sep., 1988) [Muzzio V].

F. Muzzio et al, "Mixing as a Tool for Pollution Prevention in Reactive Systems", in *Handbook of Industrial Pollution Prevention* (Invited Book Chapter, H. Freeman editor) McGraw–Hill, Chapter 27, pp. 455–466 (1994) [Muzzio VI].

(List continued on next page.)

*Primary Examiner*—Tony G. Soohoo
*Attorney, Agent, or Firm*—Howson and Howson

[57] ABSTRACT

The invention provides a method and apparatus for efficiently achieving a homogeneous mixture of fluid components by introducing said components having a Reynolds number of between about ≦1 to about 500 into a vessel and continuously perturbing the mixing flow by altering the flow speed and mixing time until homogeniety is reached. This method prevents the components from aggregating into non-homogeneous segregated regions within said vessel during mixing and substantially reduces the time the admixed components reach homogeneity.

32 Claims, 7 Drawing Sheets

OTHER PUBLICATIONS

M. Liu et al, "Quantification of Mixing in Aperiodic Chaotic Flows", *Chaos, Solitons, and Fractals,* 4(6):869–893 (1994) [Liu I].

M. Liu et al, "Fractal Structure of a Dissipative Particle–Fluid System in a Time Dependent Chaotic Flow", *Phys. Rev. E,* 50 (5):4245–4248 (Nov., 1994) [Liu II].

M. Liu et al, "Effects of Manifolds and Corner Singularities on Stretching in Chaotic Cavity Flows", *Chaos, Solitons, and Fractals,* 4(12):2145–2167 (1994) [Liu III].

M. Liu et al, "Structure of the Stretching Field in Chaotic Cavity Flows", *AIChE J.,* 40(8):1273–1286 (Aug. 1994) [Liu IV].

J. Ottino et al, "Chaos, Symmetry, and Self–Similarity: Exploiting Order and Disorder in Mixing Processes", *Science,* 257:754–760 (Aug. 7, 1992) [Ottino I].

J. Ottino et al, "Morphological Structures Produced by Mixing in Chaotic Flows", *Nature,* 333:419–425 (Jun. 1988) [Ottino II].

D. Beigie et al, "A Global Study of Enhance Stretching and Difffusion in Chaotic Tangles", *Phys. Fluids A,* 3(5):1039–1050 (May, 1991) [Beigie I].

D. Beigie et al, "Statistical Relaxation Under Nonturbulent Chaotic Flows: Non–Gaussian High–Stretch Tails of Finite–Time Lyapunov Exponent Distributions", *Phys. Rev. Lett,* 70(3):275–278 (Jan., 1993)[Beigie II].

F. O'Connell et al, "Simple Turbines in Fully Baffled Tanks", *Chem. Eng. Prog.,* 46(7):358–362 (Jul., 1950).

H. Kramers et al, "A Comparative Study on the Rate of Mixing in Stirred Tanks", *Chem. Eng. Sci.,* 2:35–42 (1953).

R. Biggs, "Mixing Rates in Stirred Tanks", *AIChE J.,* 9(5):636–640 (Sep., 1963).

K. Norwood et al, "Flow Patterns and Mixing Rates in Agitated Vessels", *AIChE J.,* 6(3):432–437 (Sep., 1960).

S. Aiba, "Flow Patterns of Liquids in Agitated Vessels", *AIChE J.,* 4(4):485–489 (Dec., 1958).

A. Desouza et al, "Fluid Dynamics and Flow Patterns in Stirred Tanks with a Turbine Impeller", *Can. J. Chem. Eng.,* 50:15–23 (Feb., 1972).

J. Sachs, et al., "Discharge Flow from Turbine–Type Mixing Impellers", *Chem. Eng. Prog.,* 59(12):597–603 (Dec., 1954).

A. Metzner et al, "Flow Patterns in Agitated Vessels", *AIChE J.,* 6(1):109–114 (Mar., 1960).

M. Yianneskis et al, "An Experimental Study of the Steady and Unsteady Flow Characteristics of Stirred Reactors", *J. Fluid Mech.,* 175:537–555 (1987).

J. Costes et al, "Study by Laser Doppler Anemometry of the Turbulent Flow Induced by a Rushton Turbine in a Stirred Tank: Influence of the Size of the Units–I. Mean Flow and Turbulence", *Chem. Eng. Sci.,* 43(10)2751–1764 (1988).

L. Dong et al, "Flow Induced by an Impeller in an Unbaffled Tank–I, Experimental", *Chem. Eng. Sci.,* 49(4):549–560 (1994).

T. Danielson et al, "Aggregation and Structure Formation in Chaotic and Regular Flows", *Phys. Rev. Lett.,* 66(24):3128–3131 (Jun., 1991).

C. Wightman et al., "The Structure of Mixtures of Particles Generated by Time–Dependent Flows", *Powder Technology,* (Sep., 1995).

H. Aref, "Stirring by Chaotic Advection", *Journal of Fluid Mechanics,* 143:1–21 (1984) [Aref I].

W. Chien et al, "Laminar Mixing and Chaotic Mixing in Several Cavity Flows", *Journal of Fluid Mechanics,* 170:355–377 (1986).

J. Chaiken et al, "Experimental Study of Lagrangian Turbulence in a Stokes Flow", *Proceedings of the Royal Society of London A,* 408:165–174 (1986).

C. Leong et al, "Experiments on Mixing Due to Chaotic Advection in a Cavity", *J. Fluid Mech.,* 209:463–499 (1989).

P. Swanson et al, "A Comparative Computational and Experimental Study of Chaotic Mixing of Viscous Fluids", *J. Fluid Mech.,* 213:227–249 (1990).

J. Sommerer et al, "Particles Floating on a Moving Fluid: A Dynamically Comprehensible Physcial Fractal", *Science,* 259:335–339 (Jan., 1993).

D. Khakhar et al. "Analysis of Chaotic Mixing in Two Model Systems", *Journal of Fluid Mechanics,* 172:419–451 (1986).

H. Aref et al., "Chaotic Advection in a Stokes Flow", *Physics of Fluids,* 29(11):3515–3521 (Nov., 1986) [Aref II].

P. Grassberger et al, "Scaling Laws for Invariant Measures on Hyperbolic and Nonhyperbolic Atractors", *Journal of Statistical Physics,* 51(½):135–178 (1988).

E. Ott et al, "Chaotic Fluid Convection and the Fractal Nature of Passive Scalar Gradients", *Phys. Rev. Lett.,* 61(25):2839–2842 (Dec., 1988).

M. Sepulveda et al, "Spectral Analysis of Conservative Dynamical Systems", *Phys. Rev. Lett.,* 63(12):1226–1229 (Sep., 1989).

V. Rom–Kedar et al, "An Analytical Study of Transport, Mixing and Chaos in a Unsteady Vortical Flow", *Journal of Fluid Mechanics,* 214:347–394 (1990).

T. Horita et al, "Long–Time Correlations and Expansion–Rate Spectra of Chaos in Hamiltonian Systems", *Progress in Theoretical Physics,* 83(6):1065–1070 (Jun., 1990).

F. Varosi et al, "The Spectrum of Fractual Dimensions of Passively Convected Scalar Gradients in Chaotic Fluid Flows", *Physics of Fluids A,* 3(5):1017–1028 (May, 1991).

M. Shlesinger et al, "Strange Kinetics", *Nature,* 363:31–37 (May, 1993).

M. Tjahjadi et al, "Satellite and Subsatellite Formation in Capillary Breakup", *J. Fluid Mech.,* 243:297–317 (1992).

A. Crisanti et al, "Dynamics of Passively Advected Impurities in Simple Two–Dimensional Flow Models", *Phys. Fluids A,* 4(8):1805–1820 (Aug., 1992).

K–K. Tio et al, "On the Dynamics of Buoyant and Heavy Particles in a Periodic Stuart Vortex Flow", *J. Fluid Mech.,* 254:671–699 (1993).

L. Wang et al, "Chaotic Dynamics of Particle Dispersion in Fluids", *Phys. Fluids A,* 4(8):1789–1804 (Aug., 1992).

L. Yu et al, "Fractal Distribution of Floaters on a Fluid Surface and the Transition to Chaos for Random Maps", *Physica D,* 53:102–124 (1991).

R. Pierrehumbert, "Large–Scale Horizontal Mixing in Planetary Atmospheres", *Physics of Fluids A,* 3(5):1250–1260 (May, 1991).

H. Riddenrikhof et al, "Chaotic Stirring in a Tidal System", *Science,* 258:1107–1111 (Nov., 1992).

H. Kusch et al, "Experiments on Mixing in Continuous Chaotic Flows", *J. Fluid Mech.,* 236:319–348 (1992).

N. Acharya et al, "Heat Transfer Enhancement in Coiled Tubes by Chaotic Mixing", *Int. J. Heat Mass Transfer,* 35(10):2475–2489 (1992).

C. Kuncewicz, "Three Dimensional Model of Laminar Liquid Flow for Paddle Impellers and Flat–Blade Turbines", *Chem. Eng. Sci.,* 47(15–16):3959–3967 (1992).

C. Perng et al, "Moving–Deforming–Mesh Technique for Simulation of Flow in Mixing Tanks", in *Process Mixing: Chemical and Biochemical Applications—Parts II,* G.B. Tatterson et al editors, AIChE Symp. Series vol. 89, No. 293, pp. 37–41 (1993).

F. Ling et al, "Mixing Windows in Discontinuous Cavity Flows", *Phys. Lett. A.,* 165:221–230 (1992).

J. Franjione et al, "Symmetries within Chaos: A Route to Effective Mixing", *Phys. Fluids A,* 1(11):1772–1783 (Nov., 1989).

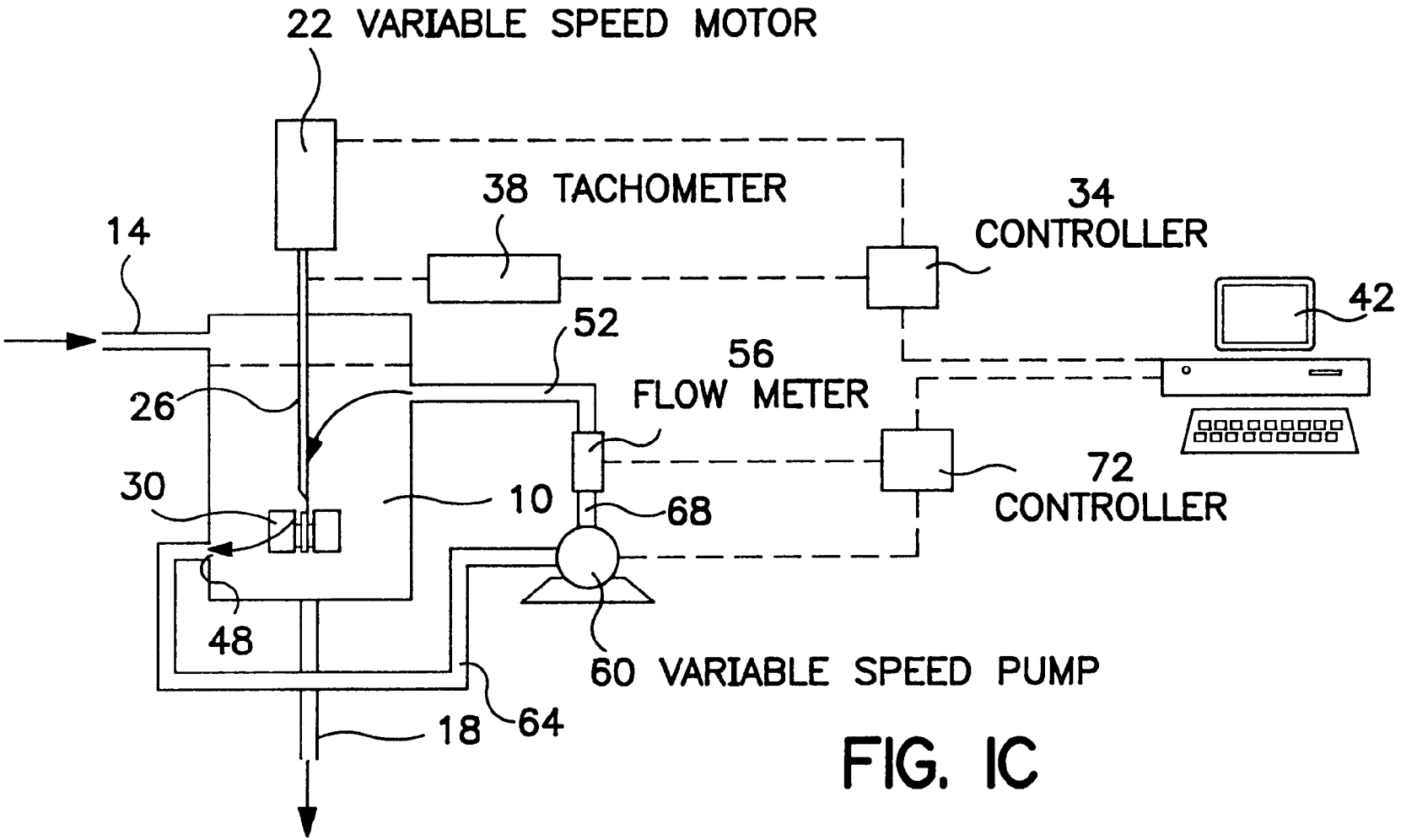
FIG. IC

METHOD OF CHAOTIC MIXING AND IMPROVED STIRRED TANK REACTORS

This is a divisional of application Ser. No. 08/533,363 filed Sep. 25, 1995, now abandoned.

This invention was supported by the Department of Energy Grant No. DEACO6-7RLO. The United States government has certain rights in this invention.

FIELD OF THE INVENTION

The present invention relates to the field of chemical, industrial and biological mixtures of miscible and immiscible fluids, solid and liquid suspensions, and gas and liquid dispersions, and the use of chemical agitated tank reactors for the production of homogeneous mixed products.

BACKGROUND OF THE INVENTION

Chemical, petrochemical, and pharmaceutical processes usually require bringing reactants (the components to be mixed) into close contact by imposing a mixing flow. Mixing is a complicated phenomenon, which even in the simplest case of mixing miscible fluids, involves a combination of three non-linearly coupled, spatially-distributed processes: convection, stretching and diffusion. Convection moves portions of material from one location to another, promoting global uniformity by redistributing initially segregated components. Stretching transforms portions of material into elongated striations, increasing the amount of contact area. Diffusion induces uniformity at small scales. These processes typically generate partially mixed structures that exhibit strong variability in local composition. Chemical reactions taking place in this inhomogeneous environment often exhibit spatially dependent rates.

The stirred tank reactor is the most common type of process equipment used to conduct mixing and chemical reactions in a wide variety of industries. Stirred tanks are versatile, and commercially available in a wide variety of sizes, impeller designs and baffle configurations. They can be used for both continuous and batch processes, they can handle reactant volumes from a few gallons to many thousands of gallons per hour, and they have been successfully used to process single liquid phases as well as liquid-liquid, gas-liquid, and solid-liquid dispersions.

However, stirred tanks have some limitations related to flow patterns within them [see, e.g., F. O'Connell et al, *Chem. Eng. Prog.*, 46:358–362 (1950); H. Kramers et al, *Chem. Eng. Sci.*, 2:35–42 (1953); R. Biggs, *AIChE J.*, 9:636–640 (1963); K. Norwood et al, *AIChE J.*, 6:432–436 (1960); S. Aiba, *AIChE J.*, 4:485–489 (1958); A. Metzner et al, *AIChE J.*, 6:109–114 (1960); L. Dong et al, *Chem. Eng. Sci.*, 49:549–560 (1994); A. Desouza et al, *Can. J. Chem. Eng.*, 50:15–23 (1972); C. Kuncewicz, *Chem. Eng. Sci.*, 47:3959–3967 (1992); and C. Perng et al, "A Moving-Deforming-Mesh Technique for Simulation of Flow in Mixing Tanks", in *Process Mixing: Chemical and Biochemical Applications —Part II*, G. B. Tatterson et al (eds), AIChE Symp. Series (1993)]. Segregated regions which form in mixtures act as barriers to mixing, substantially increasing both the mixing time and the amount of by-products generated in industrial operations.

For components having Reynolds numbers (Re) less than 500, mixing in stirred tanks is often inefficient and characterized by persistent, well defined ring vortices above and below the impeller. [See, e.g., J. Sachs et al, *Chem. Eng. Prog.*, 50:597–603 (1954); Metzner, cited above; M. Yianneskis et al, *J. Fluid Mech.*, 175:537–555 (1987); J. Costes et al, *Chem. Eng. Sci.*, 43:2751–2764 (1988) and Dong, cited above]. Contrary to the common assumption that segregation regions are readily destroyed by baffles, many of these studies have reported the persistence of well defined toroidal vortices, both in baffled and unbaffled vessels.

Although such segregated regions strongly affect the performance of reactive processes, little information about these regions has been reported in the literature, nor solutions focusing on the problems caused by the location and size of the segregated regions, nor methods for preventing their formation.

Such problems in mixing of industrial, chemical, or pharmaceutical components or reactants have both economic and technical consequences. Numerous processes of interest to industry involve mixing high viscosity materials. Examples include blending of molten polymers, reactive polymerization processes that use heterogeneous catalysts, mixing of fiber suspensions, etc. In these, as in many other processes, good mixing is often a necessary condition for process success. Mixing is sometimes inefficient, i.e., for fast reactions or viscous fluids, mixing is often slow compared to the rate of reaction. Such inefficiency in mixing may result in the slowing or even halting of desired reactions before reaching completion, the unintended enhancement of undesired reactions, and a decreased product selectivity.

The most common method for achieving homogeneity for low viscosity fluids is to use a high stirring rate, ideally inducing a turbulent flow. Unfortunately, such an approach is impractical in processes involving high viscosity fluids typical in polymerization reactions, because increases in stirring rates lead to huge increases in energy demands and the stresses required to achieve turbulent flow often exceed equipment capabilities. Moreover, such stresses can damage the materials being mixed.

In addition, for shear-thinning materials (e.g., many polymers), stronger stirring can increase segregation. Fast stirring is also impractical in many biotechnological applications where materials are shear sensitive (proteins and other macromolecule, fibers, cellular materials) and high-speed spinning at high shear rates often lead to widespread damage to proteins and other macromolecules.

There is a need in the art, therefore, for efficient methods and compositions for achieving fast and efficient mixing of high viscosity fluids in agitated tanks of fixed design under gentle or slow stirring conditions.

SUMMARY OF THE INVENTION

In one aspect, the invention provides a method for efficiently achieving a homogeneous mixture of fluid components or reactants in an agitated tank by periodically or aperiodically perturbing the mixing flow.

In one embodiment, this novel method involves periodically or aperiodically alternating the rotation speeds or rate of rotation of the mixing means (which are generally flat or curved impellers revolving around an axis) located within a mixing container throughout the total mixing time. Preferably, this method acheives substantial homogeneity of the mixture prior to completion of the reaction time for the components or reactants forming the mixture. By "substantial homogeniety" is meant that the mixture has no perceptible torii or sites of unmixed components.

In another embodiment, this method involves periodically or aperiodically alternating the speed and flow rate of a transverse flow through injection and outlet ports located on the vertical sides of a mixing container, thereby perturbing the mixing flow. Preferably, this method acheives substantial homogeneity for Reynolds numbers less than 1.

In yet a further embodiment, the method involves the combination of the above embodiments. These methods prevent the components or reactants of the mixture from segregating into non-homogeneous regions. These methods homogenize segregated regions in reaction mixtures and result in efficient mixing in agitated tanks under gentle stirring conditions. Another advantage of this invention is the reduction in the time required for the admixed components to reach homogeneity.

In another aspect, the invention provides a mixing apparatus, e.g., a stirred reaction vessel or chemical reactor, capable of efficiently mixing fluid components by periodically or aperiodically perturbing the mixing flow. In one embodiment, the mixing apparatus comprises, in brief, a container or tank for holding the components during admixture; mixing means, such as a variable speed motorized mixer which controls the rotation of curved or flat blades around an axis located within the container; and control means, such as a computer-driven controller which can periodically alternate the speed, frequency and duration of the mixing means. In another embodiment, the mixing apparatus comprises a container having on its vertical sides a plurality of inlet and outlet ports; a mixing means which comprises a pump capable of maintaining a flow of fluid components through these ports and into and out of the container; and a control means, which can be a computer-driven controller and flowmeter, which can periodically alternate the speed, frequency and duration of the flow. In yet another embodiment, the above aspects of the mixing apparatus above are combined.

Other aspects and advantages of the present invention are described further in the following detailed description of the preferred embodiments thereof.

BRIEF DESCRIPTION OF THE DRAWINGS

FIG. 1C is a schematic drawing of a mixing apparatus of the present invention. This schematic illustrates an apparatus having the ability to mix fluids according to a combination of the time-dependent alteration in the rotation rate of impeller blades and the time-dependent alteration in the recirculating flow rate.

DETAILED DESCRIPTION OF THE INVENTION

Figure 1A:
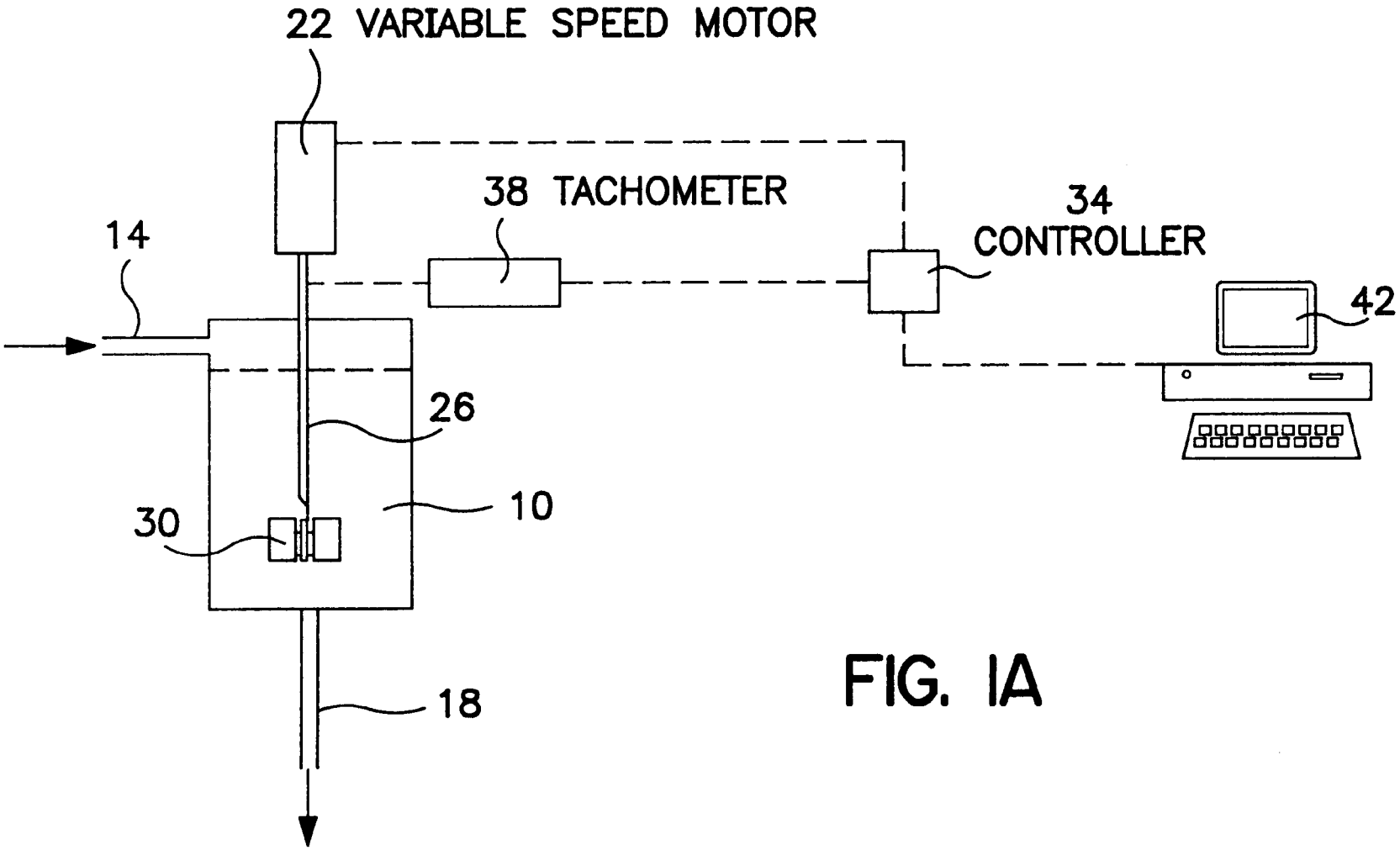
FIG. 1A is a schematic drawing of a mixing apparatus of the present invention. This schematic illustrates an apparatus having the ability to mix fluids according to the time-dependent alteration in the rotation rate of impeller blades.

The present invention provides a solution for current problems in mixing of chemical, pharmaceutical and industrial miscible and immiscible fluids, solid and liquid suspensions, and gas and liquid dispersions. This invention is particularly useful where the components of the mixture are also reactants, which require reaction as well as admixture to homogeneity. The invention provides a method and an apparatus for efficiently achieving a homogeneous mixture of fluid components or reactants in an agitated tank by continuously perturbing and alternating the rate and speed of the mixing flow. This method and apparatus involve periodically or periodically altering the mixing speeds and mixing times of modified conventional mixing apparatus, e.g., a stirred tank reactor or newly designed mixing apparatus, throughout the mixing period.

As described in detail below, the mixing function of this invention involves impeller blade rotation, pumped recirculation, or both. The efficiency of this invention is measured by the reduction in both energy used by the mixing system and in the time involved in mixing to homogeneity. Preferably, where the mixing components undergo chemical or biological reaction, the reduction in mixing time allows the mixture to reach homogeneity before the reaction time is reached or the reaction is complete.

I. The Method of the Invention

The method of the invention permits the efficient mixing to homogeneity of fluid mixtures having low to moderate Reynolds numbers in agitated tanks. By definition, a Reynolds number is the function $(\rho \times N \times D^2)/\mu$, for fluid flow calculations estimating whether flow through a mixer is streamline or turbulent in nature. N is the revolutions per second of the mixer; D is the impeller blade diameter; $\mu$ is the viscosity of the fluid; and $\rho$ is the density of the fluid. The present invention is particularly effective for mixtures characterized by Reynolds numbers of between less than 1 to about 500. More specifically, the novel mixing method of this invention was developed to enhance mixing of viscous materials and reactants. By the term "viscous materials" is meant a material or component characterized by a viscosity of $\mu \geqq 100$ centipoise (cP).

Chemical, pharmaceutical and industrial miscible and immiscible fluids, solid and liquid suspensions, and gas and liquid dispersions, which are mixed and reacted conventionally at constant stirring rates in agitated tanks, are desirably mixed by use of the method and apparatus of the present invention. Such mixtures can include both Newtonian shear-thinning and visco-elastic fluids. Examples of typical fluids suitable for application of this invention include, without limitation, polymeric materials, solid particles suspended in polymeric liquids, molten polymers admixed with reinforcers, pigments, and additives; polymerization process products that use heterogeneous catalysts; compounding polymers admixed with metal or ceramic particles; precipitation process components; fermentations involving high concentration of cells in a multicomponent medium, particularly mycellian fermentation components; pastes, creams, paints, foams, slurries and many other industrial and chemical mixtures.

While not wishing to be bound by theory, the inventors determined that theoretical concepts from non-linear systems could be used to enhance mixing in practical systems. Briefly described, there is a clear causal connection between periodic flow phenomena and the presence of poorly mixed regions in laminar flows. During the application of current mixing techniques, segregated regions form in the flow in both unbaffled and baffled vessels stirred by either flat radial or axial, or curved, flow impellers. These regions are very coherent and can have a major qualitative effect on chemical reactions taking place in a stirred tank. Example 2 below illustrates the problem to be solved, i.e., that the mixing of components at moderate Reynolds numbers using either radial and axial impellers in conventional mixing apparatus and under conventional mixing speeds produces non-homogeneous, segregated regions (torii) in stirred tanks.

The inventors determined that since the location of the segregated torus depends on the impeller rotation rate in a stirred vessel, the introduction of a fluctuation of the rotation rate would lead to widespread chaotic mixing by preventing the formation of stable torii in stirred reaction vessels. Thus, the present invention provides a method which employs the principles of chaotic mixing and which effectively prevents the formation of such segregated regions in industrial and pharmaceutical mixtures of components and/or reactants.

According to the present invention, time-dependent flow perturbations are introduced into a mixing cycle as a practical and efficient tool for enhancing mixing, particularly under conditions in which the materials to be mixed are viscous or otherwise sensitive to large increases in the speed of the mixer. As demonstrated by Example 3 below, the essential factor of the present method is to perturb the flow continuously, preventing the formation of coherent segregated regions. The dynamic flow perturbations caused by periodic changes in rotational speed of mixing (e.g., either caused by time-dependent rotation of mixer impellers or time dependent rate of a recirculating pumped flow throughout the mixer) disrupt recirculation patterns of the materials in the mixture. This disruption precludes segregated flow regions and leads to substantial or complete homogeneity of the mixture.

This invention thus leads to effective and fast mixing under low Reynolds numbers, i.e., from $\leqq 1$ to about 500. This range can span an Re of at least about 1 to about 500, or an Re of at least about 10 to about 500. See, for example, FIGS. 3A, 3B and 5A through 5D. Segregated regions are readily destroyed through the use of the method of time-dependent mixing technique of this invention. The controlled periodic or aperiodic fluctuation of either or both impeller rotation rate and recirculating flow rate throughout the mixer container according to this invention also greatly reduces the amount of time it takes to homogenize the segregated regions with the rest of the fluid.

According to this invention, a mixture of two or more components or reactants, which mixture is characterized by Reynolds numbers of $\leqq 1$ to about 500, is subjected to a total mixing protocol which comprises periodic or aperiodic fluctuations of impeller rotation rate, recirculating flow rate, or both.

Where the method of this invention provides for time-dependent flow perturbation caused by periodic or aperiodic changes in the impeller rotation rate (see FIG. 1A), the rate may vary between about 1 to about 1000 RPM. The mixing time at each RPM rate is between about 10 seconds to about 30 minutes, depending on the vessel size. It is preferred to have a total mixing duration consisting of between about 5 to about 30 cycles. One cycle for these purposes is defined as the combination of a low rotation rate for a selected mixing time and a higher rotation rate for a selected mixing time. The two mixing times need not be the same. For example, one cycle as used in Example 3B is 50 RPM for 30 seconds and 100 RPM for 30 seconds. The cycles themselves may vary in the selection of the high and low rotation rates and the respective mixing times. As discussed in more detail below, the reaction vessel or tank reactor in which this method is accomplished may vary in size, contain flat or curved impeller blades, and may contain baffles. Selection of the rotation rates, mixing times for each rotation rate, and total mixing time will naturally depend upon the Reynolds number, which is related to the size of the vessel or container, the size of the impeller, and the viscosity and density of the fluid for admixture.

Where the method of this invention provides for time-dependent flow perturbation caused by periodic or aperiodic changes in the pumping of recirculated mixture flow through the flow injection and flow outlet ports described in FIGS. 1B and 1C and discussed below, the rate of recirculation may vary between about 1% to about 100% of the volume of the tank per minute. This yeilds a recirculation residence time between about 1 to 100 minutes. Recirculation residence time is defined as the time it takes the flow to recycle once through the tank or vessel. The mixing time at each recirculation flow rate is between about 10 seconds to about 30 minutes, depending on the vessel size. It is preferred to have a total mixing duration consisting of between about 0.01 to about 1 residence times for each selected speed. As discussed in more detail below, the reaction vessel or tank reactor in which this method is accomplished must have vertically disposed flow injection (inlet) and outlet ports attached to a pump and other apparatus for altering the flow rate in a time-dependent manner. Thus, the vessel itself may vary in size, and contain multiple flow injection and outlet ports disposed around the sides of the vessel. Selection of the varying flow rates, mixing times, and total mixing time will naturally depend upon the Reynolds number, which is related to the size of the vessel or container, the size of the impeller, and the viscosity and density of the fluid for admixture.

Time-dependent flow perturbations in the mixing of components or reactants according to this invention have been observed to accomplish efficient mixing to substantial homogeneity regardless of the selection of the parameters of the method. For example, mixing is accomplished as desired when each rotation or flow rate reduction or increase (either of the impeller blade rotation or recirculated flow) is accomplished abruptly. The result is similar when the change in speed is accomplished smoothly or gradually. The method of the present invention achieves efficient admixture to homogeneity even when the rotation of the impeller blades or recirculated flow is stopped completely and then restarted between speed changes. Similarly, a selection of flow rate or RPM changes which are drastic, e.g., the slowest rate being 10% of the fastest rate, produces a homogeneous mixture, as does the selection of flow rates or RPM which are less dramatic, e.g., one rate being 75% of another. Complete aperiodicity of the mixing times and flow rate/RPM similarly produce the desired effects of this method.

It is anticipated that one of skill in the art, given the viscosity, Reynolds numbers (Re) and other parameters of the mixing apparatus and components can readily design a desired time-dependent mixing protocol according to this invention. Although the following formula is not required to accomplish this method as discussed above, generally it is preferred to keep the maximum Re constant for the entire mixing protocol. Generally, the larger the vessel, the larger the total mixing time that is required to reach homogeneity, and the lower the rotation rate or flow rate to keep the Re constant. Also, as known to one of skill in the art, the higher the Re, the more damage to shear-sensitive mixtures, hence, lower speeds are desired to avoid damaging the admixture components. Additionally, it is generally accepted that the slower the mixing rate effective for homogeneity, the better for the physical state of the mixture. However, in cases, such as those involving biological cell cultures, one must balance the rotation or flow speed vs. the need of the mixture for oxygenation. It is expected to be within the ambit of one of skill in the art to select appropriate parameters of the method of this invention based on the disclosure herein.

Where the viscosity ($\mu$) of the mixture changes during the mixing time, one method to accomplish constancy of the Re is to select rotation speeds or flow rates (N) according to the formula: $N=(Re\times\mu)/diameter^2\times\rho$. The diameter refers to the diameter of the impeller blades. The other symbols are defined above. Where the mixing method is pumped recirculating flow, lower Re (i.e., Re as low as $\leqq 1$) can be employed. Where the mixing method involves impeller rotation, the lowest Re is generally about 1. Other formulae may be developed by routine experimentation.

Preferably, in the practice of the method of this invention, periodic or aperiodic variation in mixing flow or rotation rate occurs throughout the entire mixing time, thereby preventing the components from aggregating into non-homogeneous segregated regions within the mixing apparatus during mixing. Alternatively, the components may be mixed at a single rotation or flow rate for a first set period of time, and then periodic or aperiodic rotation or flow rate fluctuations are introduced into the total mixing protocol. In this case, the periodic or aperiodic fluctuation of the rotation/flow rate disrupts segregated regions which may have formed during the first rotation rate. This method reduces the time the admixed components reach homogeneity, and for reactants, can cause homogeniety to be reached prior to the completion of the reaction time.

The method of this invention is quite robust and works for many combinations of impeller speed, impeller position, and RPM fluctuation frequency both for baffled and unbaffled vessels and for both radial, axial and curved impellers, disposed around an axis. Similarly, many combinations of flow rate, timing, vessel size, etc. operate according to an embodiment of this method. The fact that mixing is enhanced by periodically or aperiodically reducing the impeller rotation rate or recirculation flow rate may seem counter intuitive, since segregation regions are larger at lower rotation rates. Ideally one would like to operate stirred tanks under fully turbulent conditions. However, as previously stated, there are applications where high Reynolds number flows are not practical. The present invention overcomes these problems, showing that efficient mixing can be achieved under laminar conditions using variable impeller rotation rates or recirculation flow rates.

The method of this invention is applicable to a wide range of applications where low stirring or recirculation flow rates are required. It has been observed that the application of this method has been able to reduce the mixing time of a given mixture of a given size by at least about 95% from that of the same mixture stirred under conventional constant RPM in a conventional stirring vessel or mixer. This reduction in time is accompanied by a reduction in the energy required for mixing to homogeneity. An additional advantage of this method is that the reduced mixing time is more likely to be shorter than the ordinary reaction time of the mixture, thereby allowing efficient use of reactants in the fluid mixture.

II. Apparatus of this Invention

Preferably, the method of this invention is employed in a modified conventional agitated vessel or mixing apparatus or a newly designed mixing apparatus. The mixing apparatus consists primarily of a vessel for holding the components or reactants during admixture, mixing means and control means which direct the speed and duration of speed and periodic or aperiodic fluctuation of rotation/flow rate of the mixing means.

Alternatively, new stirred reaction tank or mixer apparatus may be designed with means for providing alternations in time and rotational speed of the mixer blades or flow rate. Such "means" may include computer assisted or otherwise automated mechanisms, mechanical, and electrical mechanisms which enable the speed of the mixer or flow to be increased or decreased for specified durations, for a specified total mixing time.

In one embodiment, the mixing apparatus is a conventional stirred reaction tank, in which the mixing means are impeller blades. The impeller blades can be flat or curved, and oriented axially or radially to rotate around an axis. Conventional spin reactors are designed to rotate the impeller blades at a constant speed. According to this invention, conventional mixers may be modified to enable practice of the present method, i.e., periodic or aperiodic alternations in speed of the blades, by the addition of control means. For example, such control means include a computer containing a program which controls the rate of speed and duration of the rate, and alters these parameters automatically upon the entry of suitable data into the program. Suitable data would be, for example, the Reynold's numbers and desirable RPMs, residence times, and mixing times per RPM and total mixing times. Such a computer control system may be integrated into conventional mixers with some alterations. The schematic drawings of FIGS. 1A, 1B and 1C illustrate several embodiments of a mixing apparatus according to this invention.

FIG. 1A illustrates a modified conventional mixer for use in performance of the time-dependent RPM method of this invention employing variable rotation rates and times for impeller blades. A stirred reaction tank container 10 is shown in FIG. 1A with conventional top inlet port 14 for introduction of the mixture components and bottom outlet port 18 for the exit of the mixture after mixing is complete. A mixer is shown, which comprises a variable speed motor 22, attached via axis 26 to impeller blades 30. For the purposes of this invention, the impeller blades may be flat or curved. Axis 26 is shown centrally located and vertically disposed within container 10, but can be in other positions, as is common for various commercially available stirred reaction vessels. Controller 34 is attached via tachometer 38 to axis 26. The controller controls and measures the speed and rate of rotation of blades 30. Controller 34 is driven by computer 42 which contains a program which permits the user to pre-select varying speeds of rotation and mixing times of rotations which are varied throughout the entire mixing period. Selection of the individual components from among commercially available products, e.g., a variable speed motor, a controller, tachometer, computer and a suitable program, which form this modified conventional mixing apparatus is clearly within the skill of the art. Similarly assembly of same is within the art. An exemplary bench-scale model of this apparatus is described in Example 1 below.

Figure 1B:
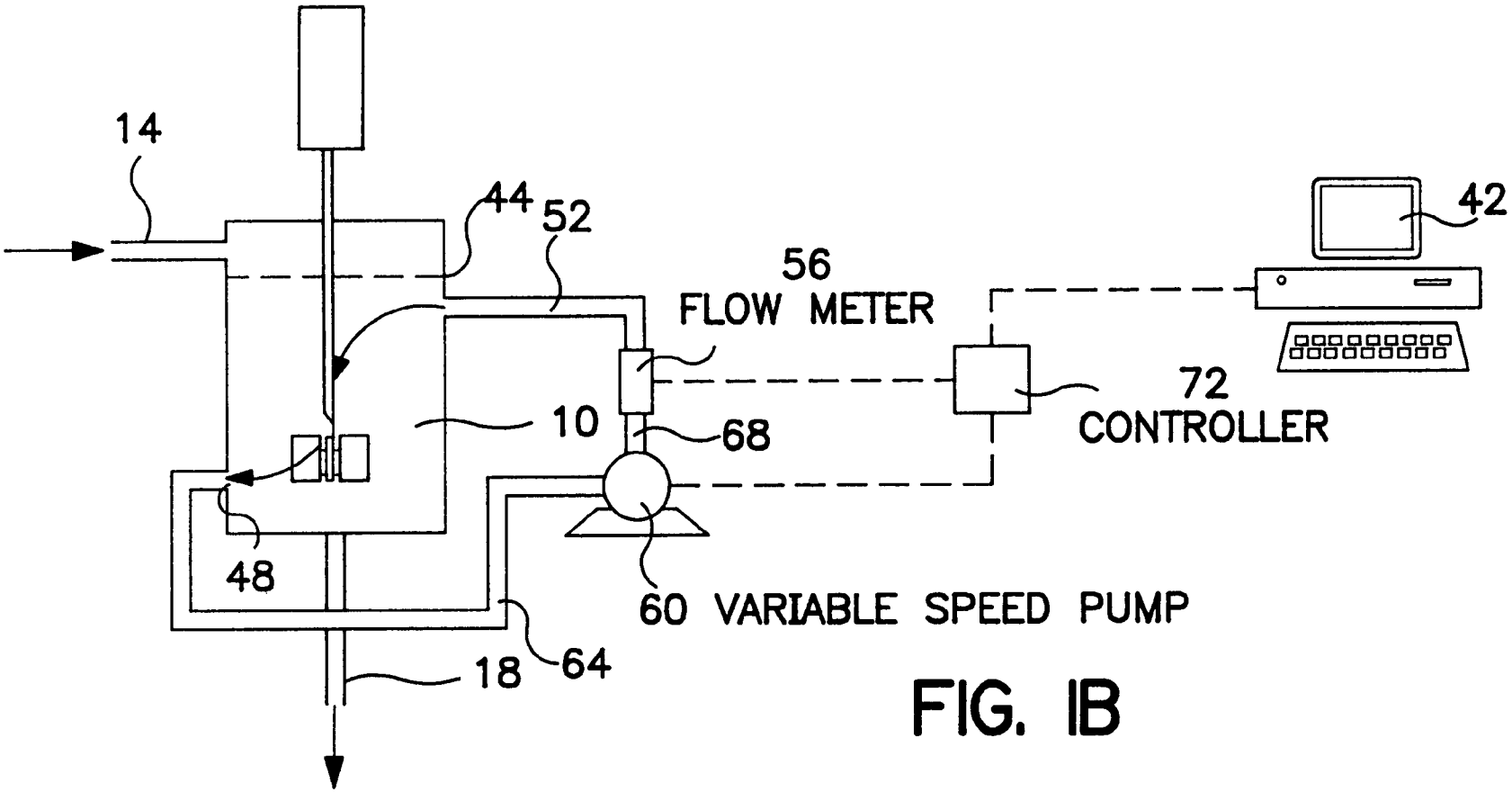
FIG. 1B is a schematic drawing of a mixing apparatus of the present invention. This schematic illustrates an apparatus having the ability to mix fluids according to the time-dependent alteration in the recirculating flow rate.

Illustrated in FIG. 1B is an alternative modification to a mixing apparatus useful in performing the method of this invention in which the flow rate throughout the vessel is alternated in a time-dependent fashion as described herein. A stirred reaction tank container 10 is shown with conventional top inlet port 14 for introduction of the mixture components and bottom outlet port 18 for the exit of the mixture after mixing is complete. Container 10 has a plurality of vertically spaced-apart flow injection ports 44 and flow outlet ports 48. In one preferred design, the apparatus contains four such injection and outlet ports; however, the number of such ports is not critical. What is critical about such ports in this mixing apparatus design is their location on the vertical sides of the container. Preferably, such flow injection and outlet ports are located opposite each other at varying distances from the top and bottom of the container, to enable the injected flow to circulate at all levels through the container. Flow injection conduit 52 leads from flowmeter 56, which measures the speed and rate of flow of the mixture components. Attached to flowmeter 56 via a conduit 68 is a variable speed pump 60, which is itself attached to the flow outlet port 48 by flow outlet conduit 64. Flowmeter 56 is attached to controller 72, which is driven by computer 42 which contains a program which permits the user to pre-select varying speeds of the flow and mixing times of flow speed, which speeds and mixing times are varied throughout the entire mixing period. The flow of components to be mixed is passed through pump 60 at a time dependent rate determined by the computer program, which permits the flow to circulate throughout the container 10 at periodic or aperiodic invervals, according to this invention. Once through container 10, the flow exits through the outlet port 48, through the conduit 64 and recirculates again through the container along the same path. The arrows indicate the path of the flow.

A third embodiment of a mixing apparatus of the present invention is illustrated by consideration of FIG. 1C, which contains both modifications of FIGS. 1A and 1B in their entirety. The same numbers are used as in the preceding figures to describe the components of this embodiment of the apparatus, which permits performance of both aspects of the method of the present invention.

The advantages of the improved mixing vessel or stirred tank reactor and methods of this invention are improved performance of chemical processes, reductions in the amount of chemical waste generated and energy consumed in chemical, pharmaco-biological and industrial processes, and increased efficiency in mixing processes. This invention has application in polymer mixing and mixing in the biotechnology industry (e.g., bioreactions used to make antibiotics) which are currently difficult to obtain. It is useful in a wide variety of conditions: different impeller speeds, different impeller designs such as flat or curved impellers, different vessel types (baffled and unbaffled reaction vessels), and vessels with a multiplicity of flow injection and outlet ports.

The method of this invention and the advantages it provides over the prior art are illustrated in the following examples. Example 1 illustrates a mixing apparatus used in the practice of this invention. Example 2 illustrates comparative data demonstrating the use and effects of conventional mixing. Example 3 illustrates the method of the present invention. This method for enhancing mixing is not limited to the conditions illustrated in FIGS. 3, 5 and 6 and described in Example 3. As described above, this time-dependent alteration in rotation or flow rates has demonstrated similar successful results for several other combinations of impeller speed, RPM fluctuation frequency, impeller positions, etc. These examples are illustrative only, and do not limit the scope of the present invention.

EXAMPLE 1

The Mixing Apparatus

An exemplary mixing apparatus of the present invention, which was employed to conduct the experiments described herein was composed of the following components.

This mixing apparatus is illustrative of a conventional stirred vessel reactor, and consists of a 10 liter (21 cm ID) cylindrical Pyrex glass vessel [Kontes Custom Glass Shop, Vineland, N.J.]. The vessel has an open top and a bottom drain. Ports are placed vertically every 2.5 inches on opposite sides of the tank (8 in total, four on each side). These ports are designed to pass a transverse flow through the system. In the experiments herein, the ports as well as the bottom drain are closed and the flow is driven solely by an impeller spun by a computer-controlled drive mounted vertically on a stand with its shaft positioned at the center of the tank. The drive [Cole-Parmer] has the capability of spanning the range of 20–900 RPM with a maximum torque of 70 oz-in.

The mixer is run following a predetermined program in which the RPM are either held constant or varied with time. Careful control of the RPM is obtained by using a Cole- Parmer Servodyne mixer controller and a 486 Gateway computer. Experiments are recorded using both a Hitachi 2500A VHS video camera and a Canon EOS Elan 35 mm photographic camera set on a tripod and focused at the impeller.

While this apparatus is sufficient to establish and exemplify the invention, it is expected that one of skill in the art can readily design or modify other mixing apparatus appropriate to industrial size mixing apparatus, or apparatus designed for desired purposes based on this disclosure. The method of the invention is also effective for destroying segregated regions observed for mixers of other designs, including baffled vessels agitated by either axial or radial impellers.

EXAMPLE 2

Mixing Under Conventional Conditions

This first set of experiments illustrates the use of conventional mixing techniques, using a conventional stirred vessel reactor and a constant rate of stirring. In each case, a poorly mixed condition results.

The tank is filled just below the 10 liter mark with glycerin, which is allowed to sit overnight to eliminate any air bubbles that might have been entrained during pumping and filling. Subsequently, approximately 100 ml of pH indicator solution (0.04% Bromothymol Blue) is added and thoroughly mixed. This solution is then made basic by the addition of a solution which consists of 1 ml of 1-N NaOH and 100 ml of glycerin. The system is mixed until a uniform color is observed.

Next, a solution of 2 ml of 1 N HCl and 200 ml glycerin (a highly viscous solvent) is added at the top of the tank and manually stirred until an acidic region of uniform depth (revealed by color) is formed at the top of the tank. Despite the fast acid-base reaction, a virtually stationary and distinct horizontal front between the acidic and basic regions of the fluid is established due to diffusion limitations caused by the highly viscous solvent, glycerin. This is necessary to ensure that results from the subsequent mixing experiments do not depend on the location of the point of addition of the acid.

Subsequently, the mixer is according to conventional mixing techniques in which the RPM are held constant with time as follows:

A. In one experiment, this system in an unbaffled tank is stirred at 50 RPM (Re=9.04) for one hour after addition of the acid. A 3 inch six-bladed radial flow impeller set 2.5 inches above the bottom of the tank is used to drive the flow. The results are illustrated in FIG. 2A.

Figure 2A:
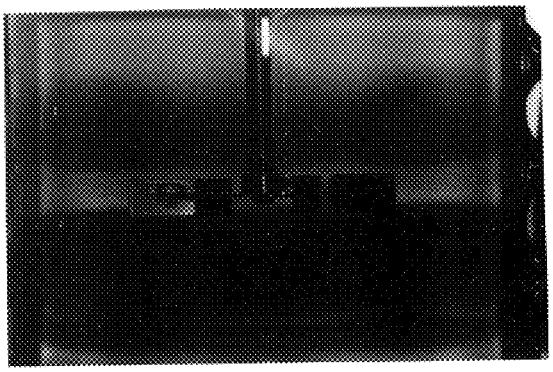
FIG. 2A is a photograph of segregated regions in a stirred tank employing a radial flow impeller in an unbaffled tank in which the system is stirred at 50 RPM (Re=9.04) for one hour after addition of acid.

While most industrial mixing processes occur at higher Reynolds numbers and use other hardware designs, the flow condition illustrated in FIG. 2A (including the impeller design and the absence of baffles) is directly relevant to some specific polymerization processes that involve high viscosity materials (100,000 cp or even higher), relatively small mixers (100 gallons or less), and low agitation rates (20 RPM or less). Since twice as much acid as base is used in the experiment, mixed regions of the stirred tank contain excess acid, causing the indicator in these regions to appear yellow.

Segregated regions, on the other hand, contain unreacted base and display a green color. As it is shown in FIG. 2A, two large toroidal regions are clearly visible both above and below the impeller. Similar regions can be observed for Newtonian fluids for Re up to at least 200, i.e., within the range of polymerization processes. These regions become larger and even more stable for shear-thinning fluids similar to those used in such polymerizations.

Under the conditions of the experiment, these regions (green "doughnuts") remain visible for several hours, segregated from the rest of the system and not mixed by convective flow mechanisms. Several hours later, acid penetrates the segregated regions due to diffusive mechanisms, neutralizing the base and yielding a homogeneous system. This experiment demonstrates that the mixing time can be quite large even for a small system such as the one exemplified.

Figure 2B:
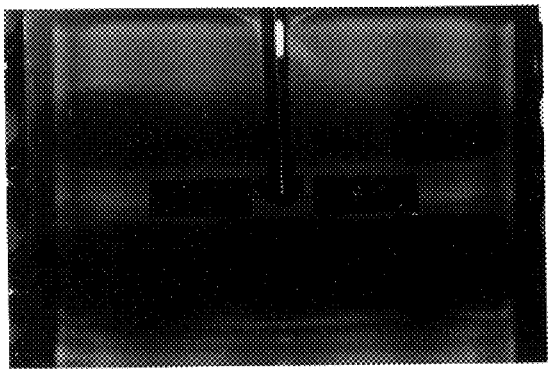
FIG. 2B is a photograph of segregated regions in a stirred tank employing a radial flow impeller in an unbaffled tank in which the system is stirred at 100 RPM (Re=18.32) for one hour after addition of acid.

B. Since the radial flow is generated primarily by inertia, the location of the toroidal regions depend on impeller rotation rate (or, equivalently, on Reynolds number). FIG. 2B shows the results for an experiment similar to that of Example 2A, in which the system is stirred at 100 RPM (Re=18.32).

Comparing FIGS. 2A and 2B, one observation immediately stands out—the segregated regions have different sizes. At 50 RPM, the segregated regions are much larger than those at 100 RPM. Also, comparing on a vertical plane, the inner edge of the torii are much closer to the impeller at 50 RPM than at 100 RPM. Also, the position of the centers of the circular cross-sections of the torii have changed. As the impeller speed is increased, the top torus moved out and downward while the bottom torus moved out and upward. The torii are pulled closer together and closer to the outer wall with increasing rotation rate. The location of segregated regions is shown to be a function of the RPM.

Figure 2C:
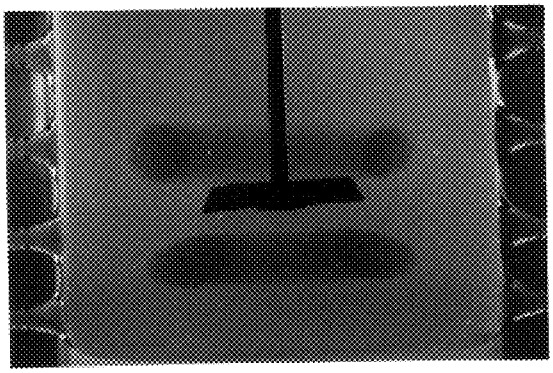
FIG. 2C is a photograph of segregated regions in a stirred tank employing an axial flow impeller in an unbaffled tank in which the system is stirred at 100 RPM (Re=13.16) for one hour after addition of acid.

C. The extent to which segregated regions are observed for other hardware designs is shown in this experiment. A prevalent belief is that segregated regions are readily destroyed by using axial flow impellers and/or by adding baffles to the tank walls. However, this is not necessarily the case. FIG. 2C illustrates an experiment in which a tank is stirred using a four-bladed 3 inch diameter axial impeller with a constant pitch. A constant impeller speed of 100 RPM, corresponding to a Reynolds number Re=13.16, is used for 60 minutes after addition of the acid (as described above). The experiment demonstrates that using an axial flow impeller does not guarantee complete mixing; quite the opposite, well-defined segregated regions are observed. Similar results were shown in an experiment with a baffled tank stirred using a 3 inch four-bladed axial flow impeller, with a constant impeller speed of 100 RPM (Re=14.4).

Figure 2D:
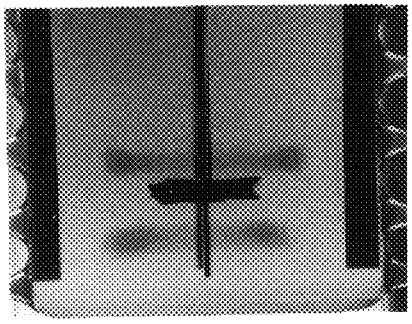
FIG. 2D is a photograph of segregated regions in a stirred tank employing an axial flow impeller in a baffled tank in which the system is stirred at 100 RPM (Re=14.41) for one hour after addition of acid.
Figure 3A:
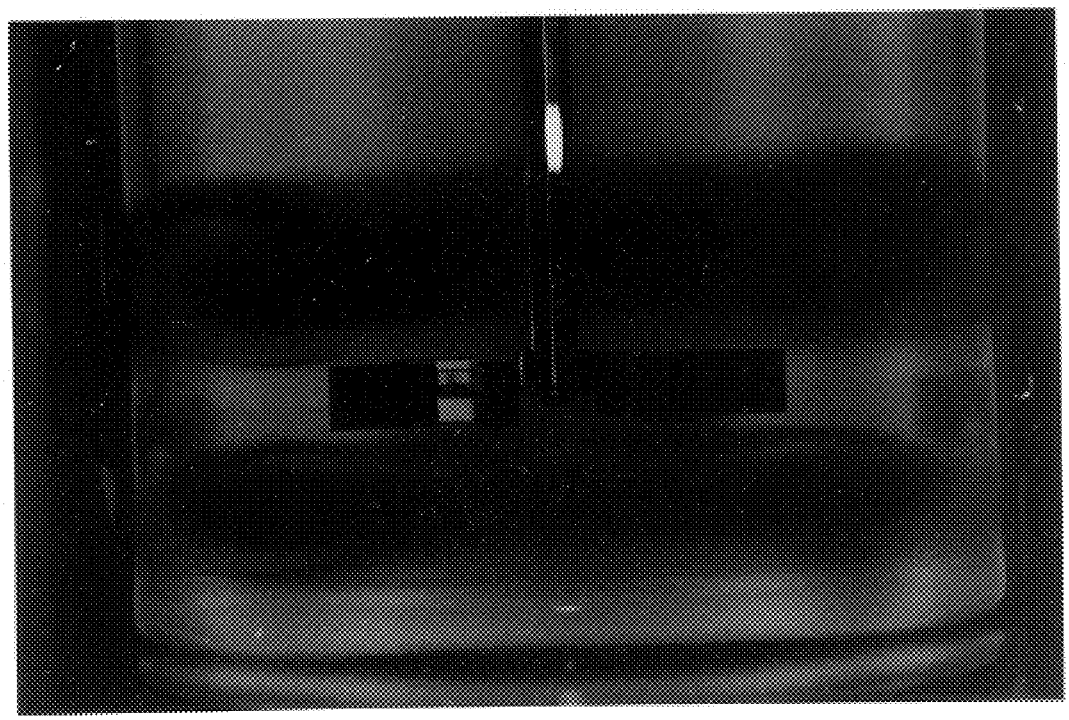
FIG. 3A is a photograph of segregated regions in a stirred tank employing a radial flow impeller undergoing the method of the present invention, i.e., time-dependent revolutions per minute (RPM), on mixing after 1.5 cycles. One cycle equals 50 RPM for 30 seconds and then 100 RPM for 30 seconds.
Figure 3B:
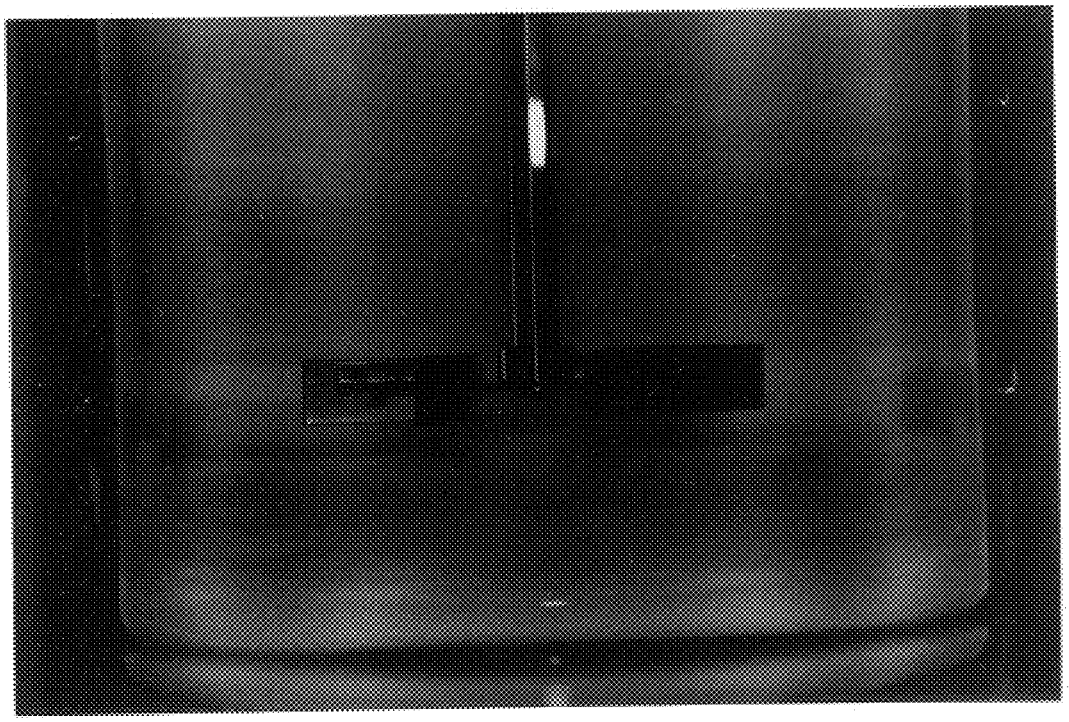
FIG. 3B is a photograph of segregated regions in a stirred tank employing a radial flow impeller undergoing time-dependent RPM on mixing after 9.5 cycles. One cycle is defined as in FIG. 3A.

D. In a similar experiment, a vessel with baffles containing the glycerin is stirred by the same impeller as described in Example 2C above. The width of the baffles is 0.75 inches (about one-tenth of the tank diameter). A constant impeller speed of 100 RPM (Re=14.41) is used for one hour. As demonstrated in FIG. 2D, large segregated regions are readily revealed.

The size and location of the segregated regions depend on Reynolds number. The segregated regions displayed in FIGS. 2A through 2D using conventional mixing techniques have a previously unknown complex internal structure closely analogous to the topology of non-chaotic islands and cantori in two-dimensional chaotic flows. This structure is revealed slowly over time by the visualization technique described above. As time increases, a combination of diffusion and convection erodes the outer layers of the torii, and highly stable filaments wrapped around a well-defined toroidal core become apparent.

EXAMPLE 3

The Method of the Invention

To illustrate the method of the present invention, flow perturbations were introduced into a stirred vessel as a means for destroying segregated regions by using time-dependent stirring rates.

Figure 4A:
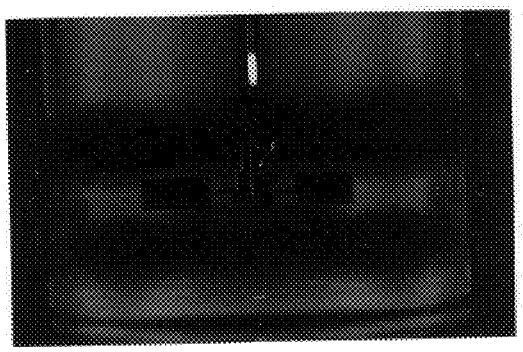
FIG. 4A is a photograph demonstrating mixing at constant speed of 100 RPM after 30.5 minutes. The coherent segregated regions are clearly evident.
Figure 4D:
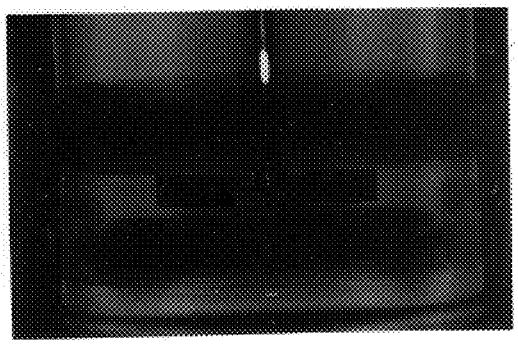
FIG. 4D is a photograph of the system defined in FIG. 4A, but employing the time-dependent RPM mixing method of the present invention, and demonstrates the results of introducing a time dependent alteration in mixing speed by mixing for 30 seconds after the impeller speed has been reduced to 50 RPM.
Figure 4B:
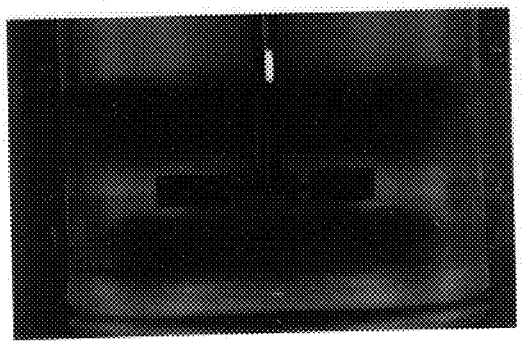
FIG. 4B is a photograph of the system defined in FIG. 4A, but employing the time-dependent RPM mixing method of the present invention, and demonstrates the results of introducing a time dependent alteration in mixing speed by mixing for 10 seconds after the impeller speed has been reduced to 50 RPM.
Figure 4E:
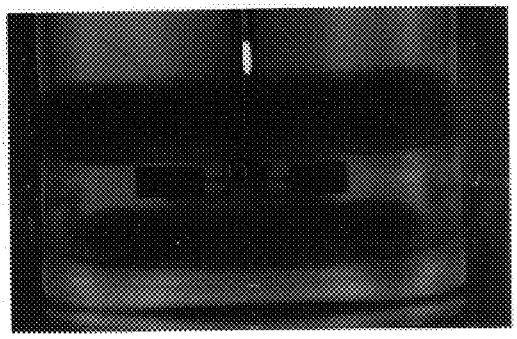
FIG. 4E is a photograph of the system of FIG. 4D after mixing for 10 seconds after the impeller speed is increased back to 100 RPM.
Figure 4C:
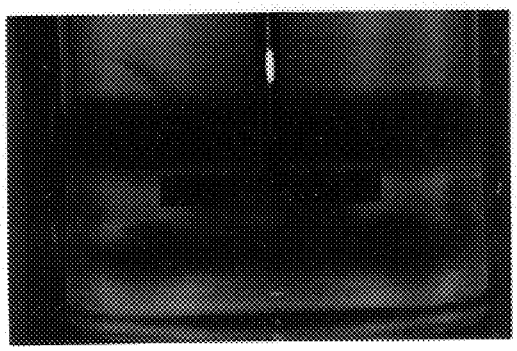
FIG. 4C is a photograph of the system defined in FIG. 4A, but employing the time-dependent RPM mixing method of the present invention, and demonstrates the results of introducing a time dependent alteration in mixing speed by mixing for 20 seconds after the impeller speed has been reduced to 50 RPM.
Figure 4F:
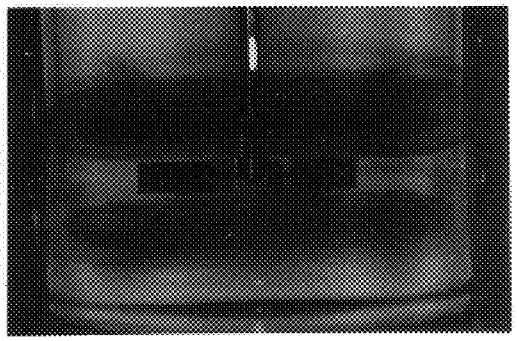
FIG. 4F is a photograph of the system of FIG. 4D after mixing for 20 seconds after the impeller speed is increased back to 100 RPM.

A. The procedure of Example 2 was followed, except that after addition of the acid, the system is agitated at a constant speed of 100 RPM for 30.5 minutes, which is sufficient time to generate well defined segregated regions (FIG. 4A). Subsequently, the system is agitated using time-dependent RPM, i.e., the stirring rate is decreased to 50 RPM for 30 seconds (FIG. 4D), then it is increased again to 100 RPM for another 30 seconds, and this 60 second cycle is repeated several times. The evolution of the system is documented by taking photographs every 5 seconds during the first two cycles, and every 30 seconds afterwards.

As is shown in FIGS. 4B through 4F, fluctuating the RPM has a dramatic effect on the persistence of the segregated regions. Each time the RPM changes, the torus corresponding to the previous RPM ceases to exist, and a new torus forms at a different location. As the rotation rate changed from 100 to 50 RPM, some of the acidic fluid in the well mixed region becomes part of the newly formed segregated region. Since the center of the new torus is displaced, rotation within the torus forms a swirl pattern of green and yellow. When the rotation rate is increased back to 100 RPM, the segregated region is reduced in size. Some of the basic green fluid is now in the well mixed region and quickly becomes neutralized. Within the segregated region, green and yellow fluid continue to swirl around each other getting better mixed.

Figure 5A:
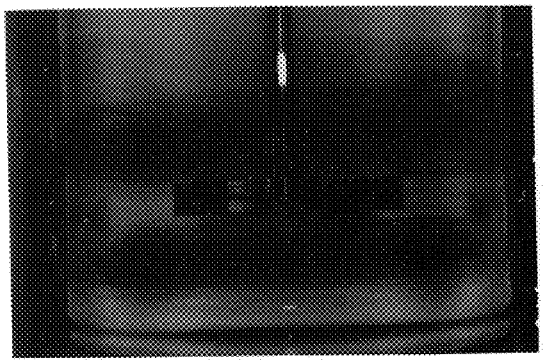
FIG. 5A is a photograph of the mixing in a stirred tank produced by periodically changing the rotation speed between 100 and 50 RPM. The fluid was first mixed at a steady 100 RPM for 30.5 minutes. Then a periodic oscillation of the impeller speed was introduced. This photograph shows the results of 1.5 periods. A period consists of rotating at 50 RPM for 30 seconds and then at 100 RPM for 30 seconds.
Figure 5B:
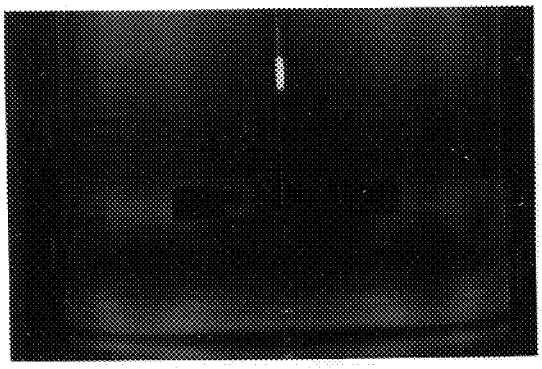
FIG. 5B shows the system of FIG. 5A after 5.5 periods.
Figure 5C:
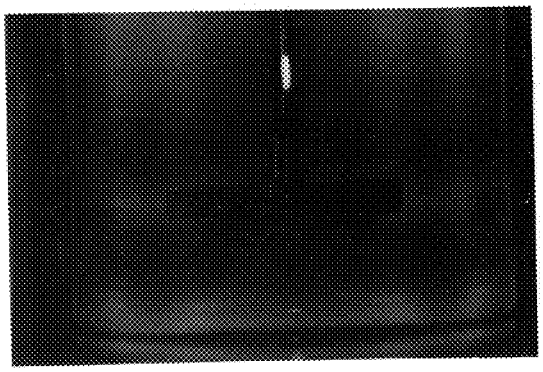
FIG. 5C shows the system of FIG. 5A after 7.5 periods.
Figure 5D:
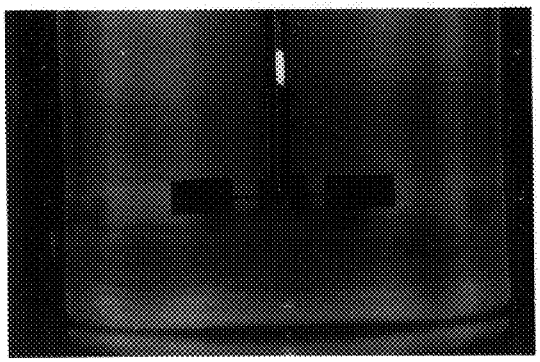
FIG. 5D shows the system of FIG. 5A after 9.5 periods.

B. Repetition of the cycles of alternating rotation, produces a finer and finer striation structure inside the torii as the number of cycles increases. As demonstrated in FIG. 5A through 5D, a stirred tank is rotated for a steady 100 RPM for 30.5 minutes, followed by periodic oscillation of the impeller speed. A cycle consists of rotating at 50 RPM for 30 seconds and then at 100 RPM for 30 seconds. The numbers of cycles is shown from 1.5 (FIG. 5A) to 9.5 (FIG. 5D).

Even more interesting is the similarity in the striation patterns seen in different cycles. There is essentially no difference in the striation patterns seen from cycle three onward. For example, FIGS. 5B and 5C look identical except for the color intensity. In other words, there is only an erosion of contrast as diffusion eliminates the locally basic regions. Such self similar striation patterns are a trademark of chaotic motion. Since in these experiments a reaction is taking place (rather than just the mixing of dyed fluids) the striations will disappear when the striation thickness becomes thinner than the diffusion length scale. FIG. 5D shows that at the end of 8 cycles of oscillation the segregated region has become mixed with the rest of the fluid to the point where it can barely be distinguished. The segregated regions are completely destroyed after a few cycles (see also FIG. 3B).

Since the unperturbed torii can persist for several hours, the significance of these experiments is that the mixing time has been reduced by more than an order of magnitude, i.e. from several hours to just a few minutes, simply by making the speed of the impeller time-dependent. The practical significance of the observation is that the amount of time required to achieve homogeneity has been decreased significantly.

Furthermore, if the RPM is allowed to fluctuate from the beginning of the experiment the segregated regions never develop, and complete mixing is achieved in a very short time. This experiment demonstrates that time-dependent stirring rates can achieve complete homogeneity in a stirred tank for Reynolds numbers as low as 10.

Hence, this invention can be used to extend the range of applicability of existing equipment. These observations have been generalized for many other stirring conditions, and have also been confirmed by preliminary computations. Moreover, it has been shown that the approach is by no means limited to stirred tanks; experimental demonstrations have already been obtained for several additional systems, including a rotating horizontal cylinder partially filled with solid particles suspended in a viscous liquid as well as several types of tumbling blenders filled with dry powders. In all cases, dynamic flow perturbations lead to fast and complete mixing.

All above-cited documents are incorporated herein by reference. Numerous modifications and variations of the present invention are included in the above-identified specification and are expected to be obvious to one of skill in the art. Such modifications and alterations to the compositions and processes of the present invention are believed to be encompassed in the scope of the claims appended hereto.

What is claimed is:

1. A method for efficiently achieving a homogeneous mixture of components or reactants comprising introducing into a stirred tank vessel said components or reactants, wherein the flow of the mixture in the vessel has a Reynolds number between $\geqq 1$ to about 500;

continuously stirring said components or reactants in said vessel to achieve a flow pattern; and continuously perturbing the flow pattern of said components or reactants in said vessel by periodically introducing a fluctuation in the flow rate, until said mixture is substantially homogeneous.

2. The method according to claim 1 wherein said mixture is selected from the group consisting of chemical, pharmaceutical or industrial miscible and immiscible fluids, solid and liquid suspensions, and gas and liquid dispersions.

3. The method according to claim 2 wherein said mixture is selected from the group consisting of a Newtonian shear-thinning fluid and a visco-elastic fluid.

4. The method according to claim 1 wherein said components are viscous materials characterized by a viscosity of $\mu \geqq 100$ centipoise.

5. The method according to claim 1 further comprising:

providing mixing means within said vessel for revolution around an axis;

introducing components to be mixed into said container; and perturbing the flow by periodically alternating the rotation speeds and mixing times of said mixing means.

6. The method according to claim 5 further comprising perturbing said flow with mixing means comprising impeller blades by periodically fluctuating the impeller blade rotation rate.

7. The method according to claim 6 further comprising perturbing said flow with mixing means comprising flat impeller blades.

8. The method according to claim 5 wherein said rotation speeds are between 1 RPM and 1000 RPM.

9. The method according to claim 5 further comprising alternating said speeds between about every 10 seconds to about every 30 minutes.

10. The method according to claim 5 wherein a total mixing time consists of between about 1 to about 30 cycles, a cycle comprising a low flow rate followed by a higher flow rate.

11. The method according to claim 6 further comprising perturbing said flow with mixing means comprising curved impeller blades.

12. The method according to claim 1 further comprising:

providing mixing means within said vessel for recirculating a flow of said mixture throughout said vessel;

introducing components to be mixed into said vessel; and perturbing the flow by periodically alternating the rate of recirculation of said flow and the mixing times of said mixing means.

13. The method according to claim 12 comprising perturbing the flow in a vessel comprising a stirred reaction tank, wherein said mixing means comprise flow injection and flow outlet ports, and a variable speed pump to recirculate said flow through said ports at said alternating rate.

14. The method according to claim 12 wherein the rate of recirculation varies between about 1 to 100% of the volume of the tank per minute.

15. The method according to claim 12 wherein the mixing time at each recirculation flow rate is between about 10 seconds to about 30 minutes.

16. The method according to claim 12 wherein the total mixing time duration consists of between about 0.01 to about 1 residence time through said vessel.

17. The method according to claim 1 further comprising:

providing mixing means within said vessel for revolution around an axis;

introducing components to be mixed into said container; and perturbing the flow by aperiodically alternating the rotation speeds and mixing times of said mixing means.

18. The method according to claim 17, further comprising perturbing said flow with mixing means comprising impeller blades by periodically fluctuating the impeller blade rotation rate.

19. The method according to claim 18 further comprising perturbing said flow with mixing means comprising flat impeller blades.

20. The method according to claim 18 further comprising perturbing said flow with mixing means comprising curved impeller blades.

21. The method according to claim 17 wherein said rotation speeds are between 1 RPM and 1000 RPM.

22. The method according to claim 17 further comprising alternating said speeds between about every 10 seconds to about every 30 minutes.

23. The method according to claim 17 wherein a total mixing time consists of between about 1 to about 30 cycles, a cycle comprising a low flow rate interval followed by a higher flow rate interval.

24. The method according to claim 1 further comprising:

providing mixing means within said vessel for recirculating a flow of said mixture throughout said vessel;

introducing components to be mixed into said vessel; and perturbing the flow by aperiodically alternating the rate of recirculation of said flow.

25. The method according to claim 24 comprising perturbing the flow in a vessel comprising a stirred reaction tank, wherein said mixing means comprise flow injection and flow outlet ports, and a variable speed pump to recirculate said flow through said ports at said alternating rate.

26. The method according to claim 24 wherein the rate of recirculation varies between about 1 to 100% of the volume of the tank per minute.

27. The method according to claim 24 wherein the mixing time at each recirculation flow rate is between about 10 seconds to about 30 minutes.

28. The method according to claim 24 wherein the total mixing time duration consists of between about 0.01 to about 1 residence time through said vessel.

29. An improved method for mixing reactants having a designated reaction time in a stirred reaction tank having impeller blades, wherein said method involves subjecting said reactants corresponding to a Reynolds number of between about $\leqq 1$ and about 500 to admixture caused by rotation of said blades, the improvement comprising periodically alternating the rotation speeds and mixing times of said impeller blades, wherein said mixture reaches homogeneity prior to completion of the reaction time.

30. An improved method for mixing reactants having a reaction time in a stirred reaction tank having flow injection and outlet ports located on the vertical sides of said tank, wherein said method involves subjecting said component corresponding to a Reynolds number of between about $\geqq 1$ to about 500 to admixture caused by recirculation of said mixture flow through said injection and outlet ports, the improvement comprising periodically alternating the flow speeds and mixing times of said mixture flow through said ports, wherein said mixture reaches homogeneity prior to completion of the reaction time.

31. An improved method for mixing reactants having a designated reaction time in a stirred reaction tank having impeller blades, wherein said method involves subjecting said reactants corresponding to a Reynolds number of between about $\leqq 1$ and about 500 to admixture caused by rotation of said blades, the improvement comprising aperiodically alternating the rotation speeds and mixing times of said impeller blades, wherein said mixture reaches homogeneity prior to completion of the reaction time.

32. An improved method for mixing reactants having a reaction time in a stirred reaction tank having flow injection and outlet ports located on the vertical sides of said tank, wherein said method involves subjecting said component corresponding to a Reynolds number of between about $\geqq 1$ to about 500 to admixture caused by recirculation of said mixture flow through said injection and outlet ports, the improvement comprising aperiodically alternating the flow speeds and mixing times of said mixture flow through said ports, wherein said mixture reaches homogeneity prior to completion of the reaction time.

* * * * *